United States Patent [19]

Guinard

[11] Patent Number: 4,509,305

[45] Date of Patent: Apr. 9, 1985

[54] DEVICE FOR CONNECTING ISOSTATIC ELEMENTS IN LINE

[75] Inventor: Pierre Guinard, Maintenon, France

[73] Assignee: Freyssinet International (STUP), Boulogne-Billancourt, France

[21] Appl. No.: 466,711

[22] Filed: Feb. 15, 1983

[30] Foreign Application Priority Data

Feb. 24, 1982 [FR] France ..... 82 03030

[51] Int. Cl.[3] ..... E04C 3/10

[52] U.S. Cl. ..... 52/223 R; 52/227; 52/229

[58] Field of Search ..... 52/223 R, 600, 227, 52/228, 229

[56] References Cited

U.S. PATENT DOCUMENTS 3,070,845 1/1963 Cheskin ..... 52/223 R 3,788,023 1/1974 Macchi ..... 52/227 X

*Primary Examiner*—Carl D. Friedman

*Assistant Examiner*—Naoko Nakazawa Slack

*Attorney, Agent, or Firm*—Ned L. Conley; David A. Rose; William E. Shull

[57] ABSTRACT

The invention relates to a device for connecting aligned butt ends of isostatic elements (generally girders) of a constructive work. Between the crosspieces connecting the opposite girder butt ends there is disposed at least one tubular cylinder prestressed by clamping screws and by a coaxial tensioned tie rod whose ends bear on the outer faces of the crosspieces. The invention is more particularly applicable to bridges formed by independent isostatic girders.

4 Claims, 4 Drawing Figures

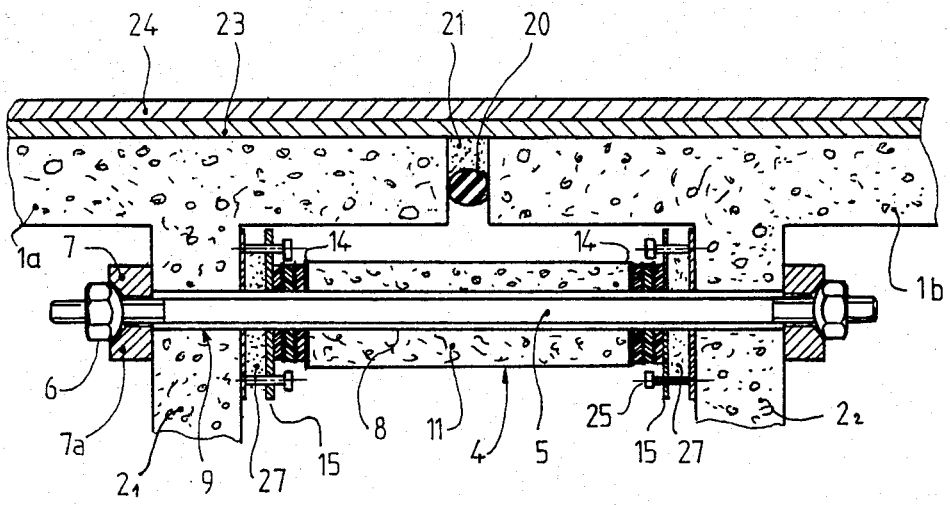
FIG_3
FIG.4
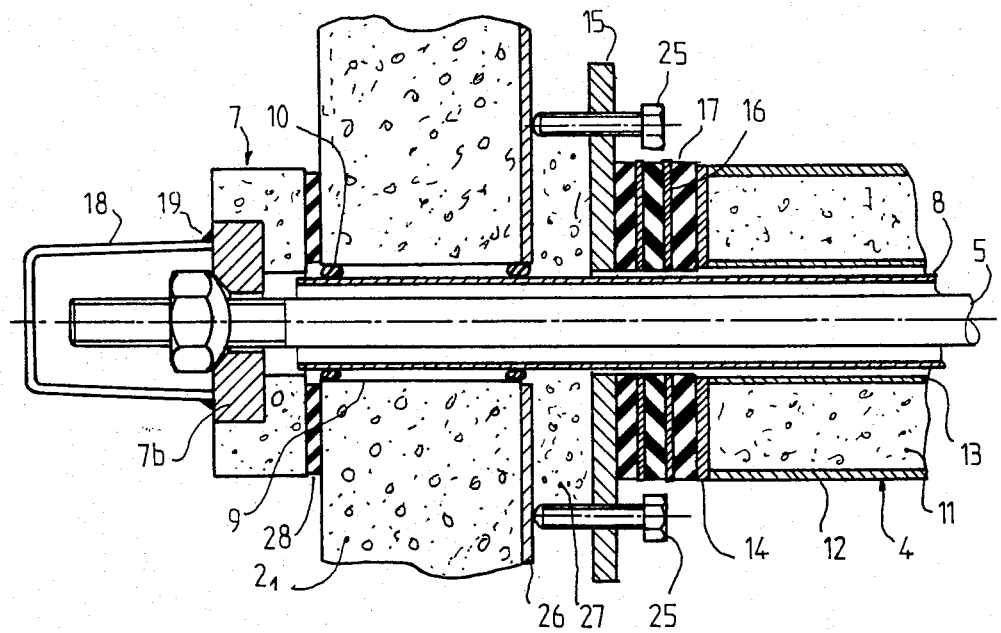

DEVICE FOR CONNECTING ISOSTATIC ELEMENTS IN LINE

BACKGROUND OF THE INVENTION

The present invention relates to a device for connecting, in line, at least two isostatic elements.

It is known that, to make wide-span constructive works with intermediate supports, it is often preferable to employ a plurality of isostatic elements or girders resting in line, each on two supports, rather than one continuous girder necessitating a strict alignment of all the supports and a reinforcement at each of the intermediate supports. In addition, the site and lengthwise profile of the work often exclude the use of continuous girders. On the other hand, each of the independent girders of the work, particularly of a bridge, then behaves individually, particularly concerning expansions and deformations (for internal or external causes), with the result that individual connecting devices are necessary at the intermediate supports.

In order to palliate these drawbacks, it has already been proposed, for two independent girders resting individually on the same double support, to connect their butt ends together by means of tensioned tie-rods and an expansion joint constituted by a surface bridging the two connected butt ends.

This embodiment proves to be unsatisfactory when put to use; on the one hand, the connection by tie rod of two butt ends of adjacent elements disposed in line does not lend itself satisfactorily to the continuity of the connection, particularly in the event of relative vertical displacements; in addition, the variations in distance between these butt ends are so great that the expansion joint devices must be complex to compensate them.

It is an object of the present invention to provide a device for connecting isostatic elements in line, which overcomes these various drawbacks.

SUMMARY OF THE INVENTION

According to the invention, the butt ends of two elements, disposed in line, are connected, in their upper part, both by a tensioned member and by at least one member compressed between these butt ends, which is pre-stressed at least by the tension of said tensioned member.

It will be noted that the upper part of the close-set butt ends of elements, hereinafter referred to as girders to simplify the description, is the part which undergoes the greatest variations in position under the loads, in other words that part of the girder which, in the case of a continuous girder, would undergo the greatest stresses.

In the first place, due to the invention, said variations are transferred to the lower part of said girders, which are adapted to undergo them without drawbacks. In addition, in the connecting device, the compressed member is preferably compressed partially before the action of the tensioned member, so that the spaced-apart relationship of two connected elements does not cause the stresses therebetween to disappear.

The connecting device according to the invention may be disposed in the plane of the webs of the butt ends of girders which it connects. To simplify production thereof, the connecting device may be disposed laterally with respect to the web and, if need be, be double and symmetrical with respect to the plane of the connected webs. Such a device may bear on flanges fast with the web of the girders; the double connecting devices preferably bear against the transverse girder or crosspiece connecting the butt ends of the assembly of the individual girders constituting an independent girder of the bridge.

Such crosspieces are virtually indispensable for the cohesion of the longitudinal girders of the same independent girder.

Each composite connecting device is preferably composed of an axial, tensioned tie rod, surrounded by a preferably cylindrical compressed element.

In order to avoid a momentary transverse imbalance, which affects an independent girder of the bridge substantially affecting the enclosing girders, by torsion effect, in an advantageous embodiment of the invention, the composite connecting element abuts against the two girder butt ends which it connects, via mechanical joints allowing a relative rotation of the connected elements. As the relative angular displacement is very little, the joint may be constituted by a laminated block of annular metal sheets and layers of vulcanized elastomers between these sheets.

BRIEF DESCRIPTION OF THE DRAWINGS

The invention will be more readily understood on reading the following description with reference to the accompanying drawings, in which:

FIG. 3 is a device for connecting two girders, in axial section.

FIG. 4 is an enlarged view of one end of FIG. 3.

DESCRIPTION OF A PREFERRED EMBODIMENT OF THE INVENTION

Figure 1:
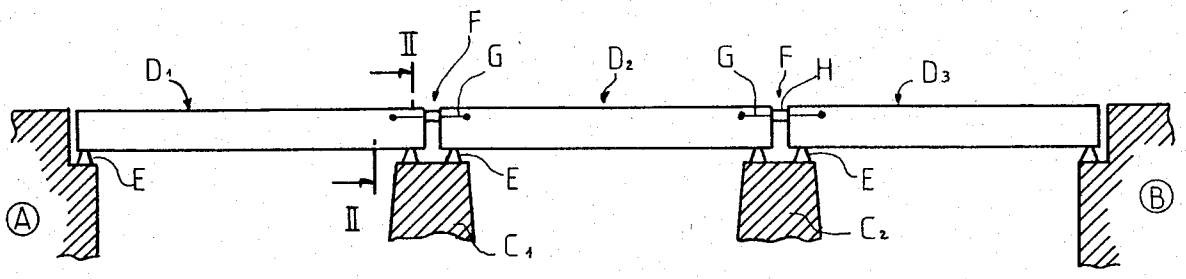
FIG. 1 shows in elevation a bridge formed by three independent girders, made according to the invention.
Figure 2:
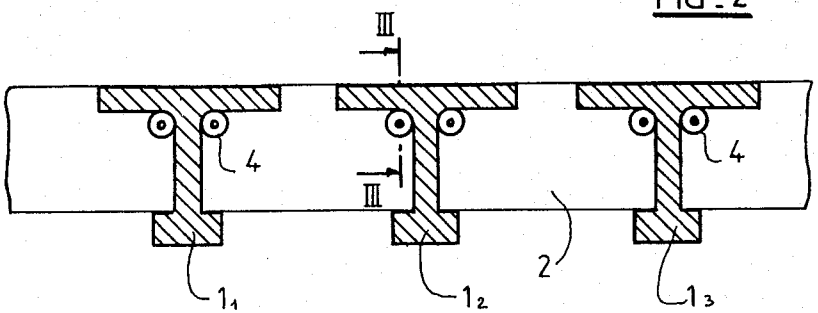
FIG. 2 is a section substantially along II—II of FIG. 1 of a bridge, in a variant embodiment.

Referring now to the drawings, in FIG. 1, between abutment piers A and B are constructed two piers C1 and C2, the whole supporting three independent bridge girders D1, D2 and D3. These girders are independent and rest at each of their ends on a bearing E adapted to allow variations in length thereof (preferably bearings made of banded elastomer).

Each girder, working independently of the other two, may be calculated separately. However, under these conditions of independence, the joint F which separates two consecutive girders may vary in width (under the effect of the loads and expansions) and in level between its opposite edges.

In order to associate successive independent girders more readily with one another, it has already been proposed to connect them by tensioned tie rods as shown schematically at G at pier C1 in FIG. 1 and, in addition, to bridge the joint by sliding elements on the butt ends of girders, which would bring about considerable variations of the joint in width and in level between its edges.

In simplified form according to the invention, the tie rods G (pier C2) maintain concrete elements H interposed between the butt ends of girders, in a state of permanent compression. In this way, such concrete elements maintain the width of the joint F virtually constant and it is consequently easy to bridge with a supple joint.

However, this device, disposed in the upper part of the girder butt ends, renders possible a certain variation of the angle formed by the opposite faces of the girder butt ends, which is easily compensated by a slight longitudinal flexion of the device bridging the joint, and by the displacement of the lower parts of the girders on their supports.

The following Figures show a practical embodiment of the invention.

The girders $1_1$, $1_2$, $1_3$ of the same independent girder are transversely connected, near their ends, by a transverse beam or crosspiece 2 which serves as support for the connecting devices 4 shown in detail in FIGS. 3 and 4.

The transverse beams $2_1$ and $2_2$ (FIG. 3), respectively connecting the beams $1_a$ and $1_b$ of two adjacent girders, are connected by tie rods 5 each formed by a steel bar threaded at its ends. The nuts 6, of the type with swivel joint, bear on conical recesses *7a* in support blocks 7. These tie rods pass through the tubes 8 which are engaged in the bores 9 made in the beams $2_1$ and $2_2$ which allow passage of said tie rods. Seals 10 housed in the bores 9 ensure a certain freedom for tubes 8 and the tightness of the channel through which the tie rod passes.

Between the beams $2_1$ and $2_2$, the tie rod 5 maintains the concrete 11 contained in a tubular cylinder formed by the concentric tubes 12 and 13 closed at their ends by annular plates 14, in a state of permanent compression.

Against the outer faces of the plates 14 are applied stacks of metal sheets 16 and layers of vulcanized elastomer 17 against these sheets.

The assembly of the hollow cylinder and the stacks is gripped between two thick plates 15 through which pass threaded pins 25, in tapped holes, of which the end abuts against the opposite faces of the crosspiece 2 via the plates 26. In this way, by gripping the pins 25, the concrete 11 enclosed in the cylinders 11 and the stacks 16, 17 is placed in a state of compression. To maintain this state of compression, a packing 27 of compact concrete is introduced between plates 15 and 26.

This prior compression reduces the effort necessary for definitive compression by the tie rod 5, and also reduces the efforts applied to the girders $1_a$ and $1_b$ in the sense of bringing together by these tie-rods 5 and finally maintains the continuity of the transmission of the efforts from one girder to the other in the case of tendency thereof to move apart. As shown, the support blocks 7 may be mixed and constituted by a metal plate (*7b*) and by a concrete body. These blocks 7 bear against the girders $2_1$ and $2_2$ via seals 28, improving the pairing of the support faces and preventing penetration of the water in the tubular elements. In addition, to this same end, the end of the tie-rod may be covered by a cap 18 fixed against the metal part of the block 7.

Finally, a linear supple joint 20 may be forced between the opposite girder butt ends; it may serve as support for a plastics substance 21 for packing the joint. The joint is covered by the water-tight layer 23 which covers the bearing surface of the girders and the whole is coated with the wear layer 24.

The variations in the state of stress of the girders upon passage of loads bring about both variations in the state of tension of the tie rods and of compression of the tubular cylinders, which variations tend to compensate one another so that the distance between the upper parts of opposite girder butt ends varies very little.

This variation is all the less as the pre-stressed assembly constituted by the tie rod and the tubular cylinder is compressed to a length such that it may compensate, without substantially varying in length, the forces which tend to vary the distance between the butt ends of the two girders. In addition, a slight variation in the alignment of the plane of the webs may be compensated by the annular stacks of metal sheets and layers of elastomer and by the clearance formed by the coaxial tubes 8 and 13 and the freedom of the tie rod 5 in the tube 8.

The practical invariability of the distance between the upper parts of the butt ends of girders brings about a possible displacement of their lower parts, which is allowed by the devices for supporting the girders on their supports. In this way, the angle formed by the opposite faces of the transverse beams is capable of varying upon passage of loads rolling over the bridge.

A connection by articulated and pre-compressed concrete elements is thus made between successive isostatic girders of a constructive work, which considerably simplifies the production of the joints between these girders.

The invention is applicable to all constructive works, and in particular to bridges formed by independent girders.

What is claimed is:

1. A device for connecting together the upper parts of adjacent, opposing butt ends of isostatic elements disposed in line with one another, comprising:

at least one tensioned tie rod having a longitudinal axis and being disposed between said upper parts of said opposing butt ends of said isostatic elements;

a pre-compressed member also disposed between said upper parts of said opposing butt ends of said isostatic elements, said pre-compressed member having a longitudinal axis and being brought into a state of substantially permanent pre-compression at least in part by said tie rod;

said tie rod being longitudinally coaxially disposed within and extending through said pre-compressed member; and said pre-compressed member being a tubular cylinder filled with concrete and freely traversed by said tie rod.

2. The device of claim 1, wherein each end of said tubular cylinder bears against a lateral appendix of the respective isostatic element via a stack composed of alternate metal sheets and layers of elastomer.

3. The device of claim 2, wherein said tubular cylinder and said stacks are compressed between two plates, each plate being disposed between one of said stacks and the respective one of said lateral appendices, and each of said plates bearing against said lateral appendices via threaded clamping pins which pass through tapped holes in said plates and abut against said lateral appendices.

4. The device of claim 3, wherein the space between each plate and the opposite face of the appendix is packed with concrete.

* * * * *